US009357817B2

(12) United States Patent
Lee et al.

(10) Patent No.: US 9,357,817 B2
(45) Date of Patent: Jun. 7, 2016

(54) REVERSIBLE WRIST STRAP INSERT AND CURVED CUTOUT FOR CENTERING WRIST STRAP

(71) Applicant: Salutron, Inc., Fremont, CA (US)

(72) Inventors: Yong Jin Lee, Palo Alto, CA (US); Robert McClain, Fremont, CA (US)

(73) Assignee: Salutron, Inc., Fremont, CA (US)

( * ) Notice: Subject to any disclaimer, the term of this patent is extended or adjusted under 35 U.S.C. 154(b) by 151 days.

(21) Appl. No.: 13/756,254

(22) Filed: Jan. 31, 2013

(65) Prior Publication Data

US 2014/0083133 A1 Mar. 27, 2014

(51) Int. Cl.
*A44C 5/14* (2006.01)
*A44C 5/20* (2006.01)

(52) U.S. Cl.
CPC ..... *A44C 5/14* (2013.01); *A44C 5/2071* (2013.01); *Y10T 29/49945* (2015.01)

(58) Field of Classification Search
CPC .... G04B 37/1486; A44C 5/14; A44C 5/2071; Y10T 24/4718; Y10T 24/4782; Y10T 29/49945
USPC ..... 224/164, 167, 169, 174, 176; 368/281, 368/282
See application file for complete search history.

(56) References Cited

U.S. PATENT DOCUMENTS

| | | | | | |
|---|---|---|---|---|---|
| 4,664,533 | A * | 5/1987 | Wollman | | 368/282 |
| 5,146,437 | A * | 9/1992 | Boucheron | | 368/282 |
| 5,206,841 | A * | 4/1993 | Boucheron | | 368/276 |
| 6,168,055 | B1 * | 1/2001 | Grados | | 224/152 |
| 6,176,612 | B1 * | 1/2001 | Chagnoux | | 368/282 |
| 6,712,501 | B2 * | 3/2004 | Kinkio et al. | | 368/281 |
| 2005/0111306 | A1 * | 5/2005 | Saaski et al. | | 368/282 |
| 2005/0265132 | A1 * | 12/2005 | Ho | G04B | 37/1486 368/282 |

* cited by examiner

*Primary Examiner* — Corey Skurdal
(74) *Attorney, Agent, or Firm* — Vieera Magen Marcus LLP

(57) ABSTRACT

A device is disclosed for wearing on a wrist or other body part including a central piece held on the body part by a pair of straps. The proximal end of a strap includes a mounting pin for sliding into and out of a slot on the central piece. The proximal end of the strap further includes a positioning curve which mates with a correspondingly shaped receiving curve on the central piece when the strap is properly affixed and centered on the central piece. When properly affixed and centered on the central piece, the positioning curve on the strap aligns with the receiving curve of the central piece, so that the positioning and receiving curves are at their lowest energy state, resisting lateral movement out of a centered position.

32 Claims, 9 Drawing Sheets

Fig.4
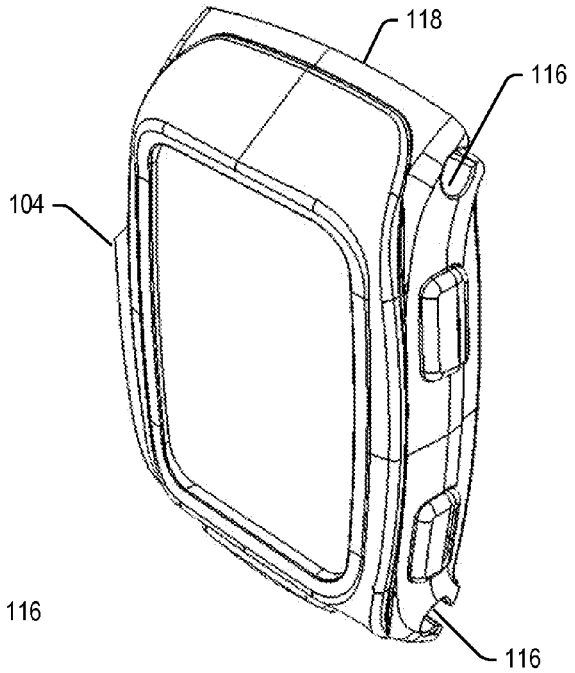
Fig.5
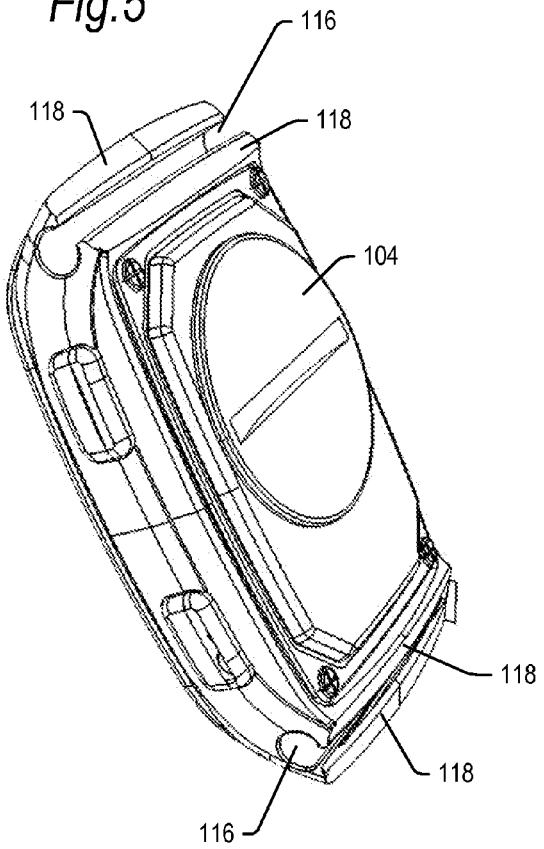
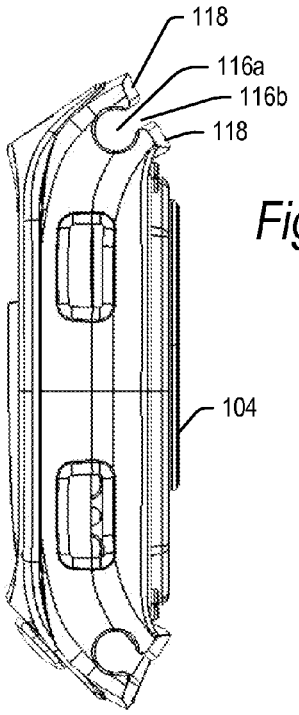
Fig.6

REVERSIBLE WRIST STRAP INSERT AND CURVED CUTOUT FOR CENTERING WRIST STRAP

BACKGROUND

Activity monitors have become popular as a tool for promoting exercise and a healthy lifestyle. In addition to keeping time, an activity monitor can include a wide variety of devices for providing biometric information, such as for example a pulse monitor for monitoring heart rate, and an accelerometer which can measure motions such as steps taken while walking or running to provide an estimate of an amount of calories used. Moreover, user-specific information such as age, gender, height and weight can be used to tailor the estimate to the user. Such monitors can be worn on the wrist or arm, for instance. The monitor can be worn during an intended workout period or as a general, all day, free living monitor, where the user may perform specific exercises at some times while going about their daily activities at other times, e.g., including sitting, standing and sleeping.

A typical monitor may be affixed to a wrist or arm with a pair of straps which fold around the wrist or arm, and then affix to each other with a clasp having mating portions on the respective straps. Often, a first strap will have holes along at least a portion of the length of the strap, and the second strap will have a pin which mates in one of the holes of the first strap. The straps may be adjusted for wrists and arms of different sizes by choosing to mate the pin within the appropriate hole along the length of the first strap.

It is known to provide detachable straps on these monitors. In one example, the monitor and strap may have a slot and mounting pin arrangement, for example with a mounting pin on the strap seated within a slot on the monitor. To detach the strap, the strap slides laterally transverse to the longitudinal axis of the device to remove the mounting pin from the slot.

One drawback to such a conventional pin and slot arrangement is that the strap may unintentionally slide laterally with respect to the monitor, for example when the wearer is exercising or the monitor is otherwise jolted. This can result in unintentional separation of the strap from the monitor and the device falling off the wearer's wrist.

SUMMARY

Embodiments of the present technology relate to a device worn on a wrist or other body part and including a central piece fastened in place by a pair of straps. The straps fold around a wearer's wrist or other body part and may be fastened together with a clasp. The straps are removable and reversible. That is, each strap includes first and second surfaces, either one may be affixed to the central piece to face outward, away from the wrist.

Each strap further includes a proximal end which attaches to the central piece and a distal end opposite the proximal end. The proximal end of the strap includes a mounting pin, for sliding into and out of a slot on the central piece, and a positioning curve. The positioning curve is a concave curve formed in the proximal end of each strap, which mates with a correspondingly shaped convex receiving curve on the central piece when the strap is properly affixed and centered on the central piece. When properly affixed and centered on the central piece, the positioning curve on the strap aligns with the receiving curve of the central piece, so that the positioning and receiving curves are at their lowest energy state.

When a strap is pushed from a centered position laterally transverse the longitudinal axis, the positioning curve on the strap will no longer align properly with the receiving curve on the central piece, and the positioning curve of the strap will no longer be in its lowest energy state. The positioning curve gravitates toward its lowest energy state, and will resist moving laterally transverse to the longitudinal axis of the device out of its properly aligned and centered position.

In an example, present technology relates to a device for wearing on a body part, the device having a longitudinal axis the device comprising: a central piece including a slot transverse to the longitudinal axis and a first curved surface; and a strap removably connecting to the central piece, the strap including a mounting pin removably mating within the slot of the central piece and a second curved surface removably mating with the first curved surface.

In a further example, the present technology relates to a device for wearing on a body part, the device having a longitudinal axis the device comprising: a central piece including a slot transverse to the longitudinal axis and a first curved surface; and a strap removably connecting to the central piece, the strap including a mounting pin removably mating within the slot of the central piece and a second curved surface removably mating with the first curved surface, the second curved surface deforming upon engaging the strap with the central piece and disengaging the strap from the central piece.

In another example, the present technology relates to a method for positioning a removable strap on a central piece in a device including the removable strap and central piece, the device having a longitudinal axis the device comprising: (a) forming a slot in the central piece transverse to the longitudinal axis; (b) forming a first curved surface in the central piece adjacent the slot; (c) forming a mounting pin on the strap; (d) forming a second curved surface in the strap adjacent the mounting pin; and (e) configuring the second curved surface to deform when the mounting pin is affixed in the slot and when the mounting pin is separated from the slot, the second curved surface deforming due to misalignment of points of contact along the first and second curved surfaces.

This summary is provided to introduce a selection of concepts in a simplified form that are further described below in the description. This summary is not intended to identify key features or essential features of the claimed subject matter, nor is it intended to be used as an aid in determining the scope of the claimed subject matter.

DESCRIPTION OF THE DRAWINGS

FIG. 4 is a front perspective view of a central piece including a pair of slots and receiving curves according to embodiments of the present technology.

FIG. 5 is a rear perspective view of a central piece including a pair of slots and receiving curves according to embodiments of the present technology.

FIG. 6 is a side view of a central piece including a pair of slots and receiving curves according to embodiments of the present technology.

DETAILED DESCRIPTION

The present technology will now be described with reference to FIGS. 1 through 12, which in embodiments, relate to removable and reversible straps, each strap including a curve to aid in maintaining the strap centered with respect to a central piece held by the straps. It is understood that the present invention may be embodied in many different forms and should not be construed as being limited to the embodiments set forth herein. Rather, these embodiments are provided so that this disclosure will be thorough and complete and will fully convey the invention to those skilled in the art. Indeed, the invention is intended to cover alternatives, modifications and equivalents of these embodiments, which are included within the scope and spirit of the invention as defined by the appended claims. Furthermore, in the following detailed description of the present invention, numerous specific details are set forth in order to provide a thorough understanding of the present invention. However, it will be clear to those of ordinary skill in the art that the present invention may be practiced without such specific details.

The terms "top" and "bottom," "upper" and "lower," and "vertical" and "horizontal" and "front" and "back" as may be used herein are by way of example and illustrative purposes only, and are not meant to limit the description of the invention inasmuch as the referenced item can be exchanged in position and orientation. Also, as used herein, the terms "substantially" and/or "about" mean that the specified dimension or parameter may be varied within an acceptable manufacturing tolerance for a given application. In one embodiment, the acceptable manufacturing tolerance is ±0.25%.

Figure 1:
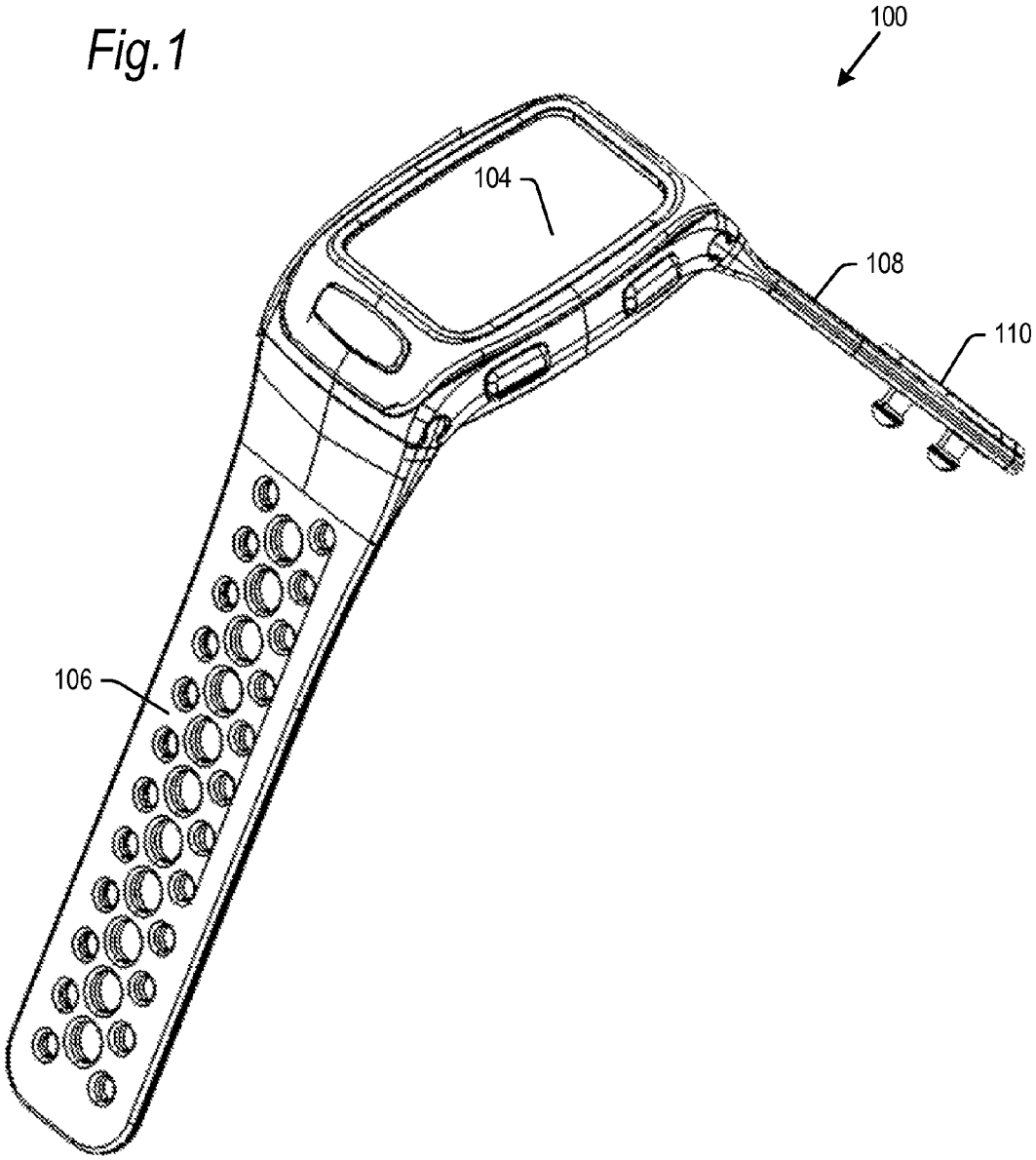
FIG. 1 is a perspective view of a device including aligned and centered straps according to embodiments of the present technology.
Figure 2:
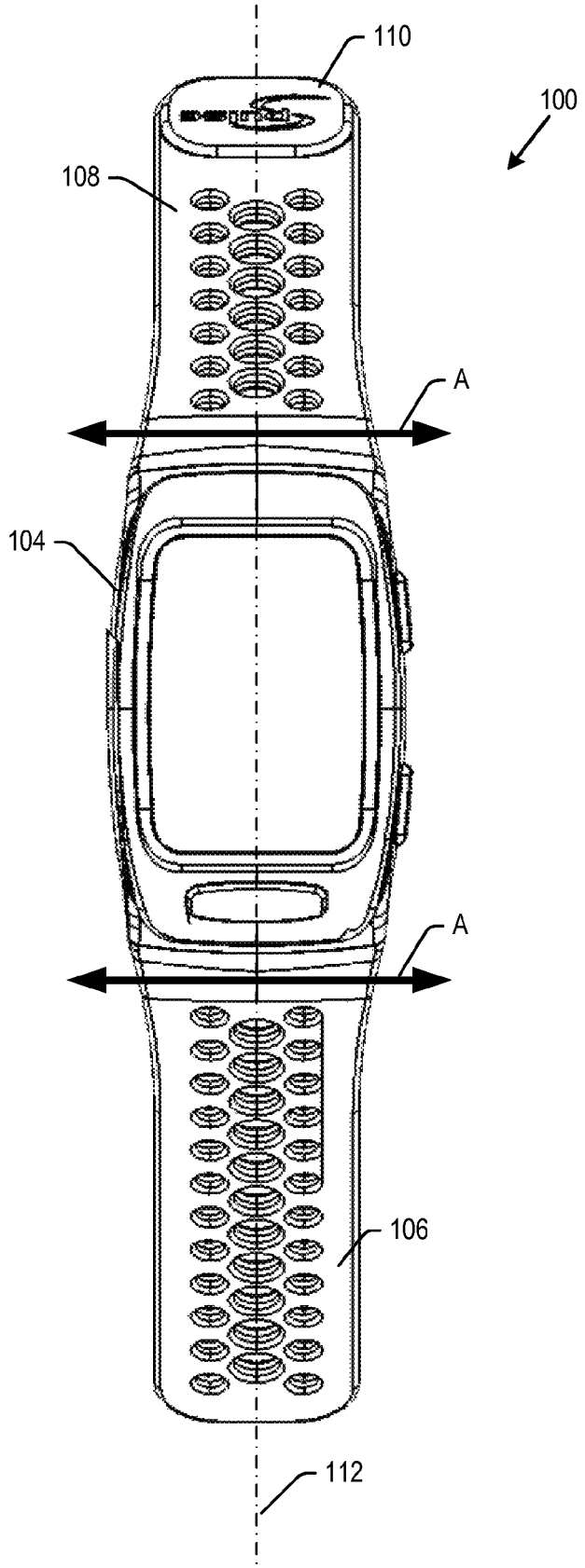
FIG. 2 is a top view of a device including aligned and centered straps according to embodiments of the present technology.
Figure 3:
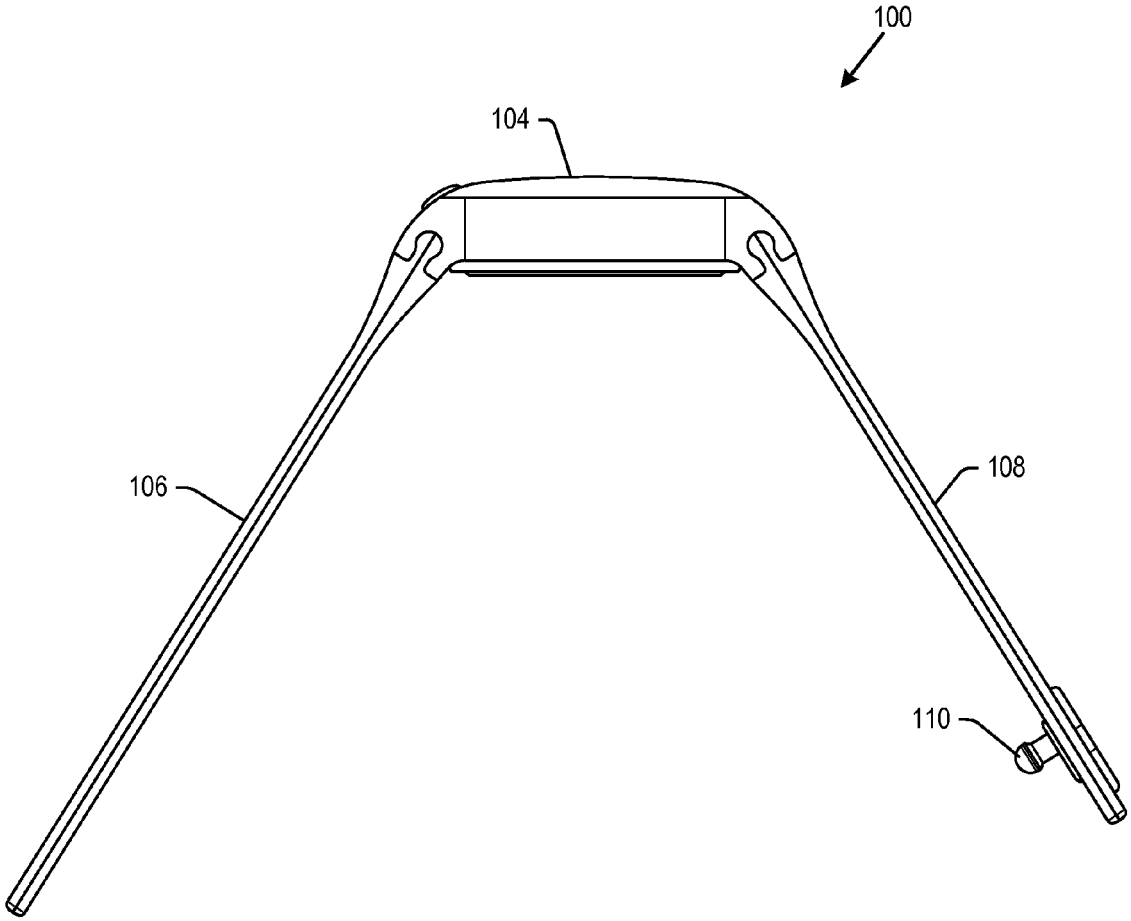
FIG. 3 is a side view of a device including aligned and centered straps according to embodiments of the present technology.

Referring initially to the perspective, front and side views of FIGS. 1, 2 and 3, respectively, there is shown a device 100 including a central piece 104 which may be affixed to a wrist of a wearer by fixing a first strap 106 to a second strap 108 around the wearer's wrist. The device 100 is described in the embodiments below as being affixed around a wrist. However, it is understood that the device 100 may be affixed around other body parts in further embodiments, including for example an arm, ankle, leg, head or neck. Although not critical to embodiments of the present invention, central piece 104 may have a length of approximately 53 mm, a width of approximately 30 mm and a thickness of approximately 13 mm. Is understood that the length, width and/or thickness may be larger or smaller than that in further embodiments.

The type and function of central piece 104 are not critical to the operation of embodiments of the present invention, but may for example be any of various monitors such as a watch, timer, pulse monitor, pedometer or other accelerometer, calorie counter, smart phone, video phone, digital assistant, digital display and/or calculator. In further embodiments, central piece 104 need not be a monitor or functioning device. It may for example alternatively be part of a bracelet or jewelry provided for aesthetic value.

The straps 106 and 108 may be formed of a variety of flexible materials including for example polyurethane and/or silicone. Other rubbers, plastics, elastomers and materials are contemplated. In embodiments, the straps 106 and 108 may be formed of a combination of silicone and nylon. The nylon may be used for more rigid portions of the straps, such as for example the mounting pin 120 described below, and silicone may be used for the more flexible portions, such as the positioning curve 124 and remainder of the strap. In such an embodiment, the nylon and silicone may be co-molded together, with the nylon extending down into a portion of the straps formed by silicone.

As explained below, the positioning curves 124 need to be a little flexible to allow deformation of the positioning curves when a strap is slid onto or off the central piece, but not too flexible such that sliding and separation of the straps from the central piece occurs too easily. In one example, the positioning curves 124 and other portions of the strap may have a stiffness (durometer measurement) of 85. The stiffness may be higher or lower than 85 in further embodiments.

As described below, straps 106 and 108 may be removable and reversible. That is, one or both straps 106, 108 may be removed from the central piece 104, flipped over and reattached to the central piece 104.

In embodiments, strap 106 may include a number of fastening holes spaced along its length, or a number of pairs of laterally aligned fastening holes spaced along its length. These fastening holes/hole pairs are provided for receiving a pin/pair of pins from a pin plate 110 mounted on strap 108. Other techniques may be used to affix the straps 106, 108 to each other around a wearer's wrist or other body part.

Although not critical to the present technology, in embodiments, the strap 106 may have a length of 105 mm, a width of 28 mm and a thickness of between 1 and 2 mm. The thickness of strap 106 may increase to approximately 6.85 mm at a proximal end of strap 106, due to the presence of the positioning curves at both the first and second surfaces of the strap 106 as explained below. It is understood that the length, width and/or thickness of strap 106 may be larger or smaller than that in further embodiments. Strap 108 may be formed of the same material as strap 106, and with the same width and thickness as strap 106. In embodiments, strap 108 may have a length of 90.5 mm, though the length may be greater or lesser than this in further embodiments.

Both straps 106, 108 may have proximal ends removably affixed to the central piece as explained below, and distal ends opposite the proximal ends. The strap 108 may include one or more holes at its distal end for receiving a pin plate 110. When worn by a user, the pin plate 110 may be affixed to strap 108 so that pins on the pin plate extend through strap 106 (toward the skin of the user) to fix the device 100 to the wrist or other body part of the user. The pin plate 110 may be reversible. That is, it may be mounted on either surface of strap 108, depending on which surface of the strap 108 is facing outward away from a user's wrist.

Referring now to the top view of FIG. 2, straps 106 and 108 may be separated from the central piece 104 by sliding the straps 106 and/or 108 laterally transverse to a longitudinal axis 112 in the direction of arrows A. The mechanisms for accomplishing this will now be explained with reference to FIGS. 4 through 7. In general, these mechanisms include a mounting pin 120 on the proximal end of strap 106 slidably received within a first slot 116 at a first side of the central piece 104, and a mounting pin 120 on the proximal end of the strap 108 slidably received within a second slot 116, identical to the first slot, on the opposite side of the central piece 104. The mechanisms for removably affixing straps 106, 108 to the central piece 104 further include the positioning curves 124 on straps 106, 108 which mate with receiving curves 118 on the central piece 104. As the affixation and removal of the straps with respect to the central piece 104 by the above mechanisms are identical for both straps 106 and 108, the following describes the affixation and removal of strap 106. It is understood that the following description applies equally to the affixation and removal of strap 108.

Referring initially to the front perspective, rear perspective and side views of FIGS. 4, 5 and 6, central piece 104 includes a pair of slots 116 at opposed sides of the central piece. The slots 116 extend in a straight line across a width of the central piece 104. Each slot 116 includes a relatively enlarged portion 116*a* (FIG. 6) for snugly receiving a mounting pin 120 on the strap 106 as explained below, and a relatively more narrow portion 116*b* which prevents the mounting pin 120 from being pulled out of the slot 116 in the direction along the longitudinal axis 112. This configuration of slots 116 allows the mounting pin 120 to be removed by sliding the mounting pin 120 laterally transverse to the longitudinal axis 112 relative to the slot 116.

The central piece 104 further includes first and second pairs of curved surfaces 118 adjacent slots 116 at the opposed sides of the central piece 104. The curved surfaces 118 are referred to herein as "receiving curves." In one embodiment, receiving curves 118 are convex and have a radius of curvature of 103.35 mm. It is understood that the radius of curvature of receiving curves 118 may be larger or smaller than that in further embodiments. In embodiments, all receiving curves have the same radius of curvature, but it is conceivable that the radius of curvature of different receiving curves 118 on the central piece 104 be different from each other.

Each receiving curve 118 in a pair of receiving curves is positioned on different sides of the slot 116. As explained below, the strap 106 includes a pair of positioning curves at the proximal end of the strap, one receiving curve at a first surface and one receiving curve at a second surface. When the strap 106 is affixed to the central piece 104, one positioning curve will engage one of the receiving curves on a first side of slot 116 as explained below, and the other positioning curve will engage the other receiving curve of the pair on the second side of the slot 116.

While the discussion that follows may discuss one positioning curve in contact with one receiving curve, it is understood that the same contact may be taking place between the second positioning curve at the opposite surface of the strap 106 and second receiving curve at the opposite side of the slot 116. However, in a further embodiment, it is conceivable that the strap 106 may include positioning curves at both surfaces (so as to be reversible), but that the central piece 104 only include a single receiving curve adjacent the slot 116. In a still further embodiment, the strap 106 may not be reversible, in which case there may be a single positioning curve at the proximal end of strap 106 which mates with a single receiving curve at a slot 116.

Figure 7:
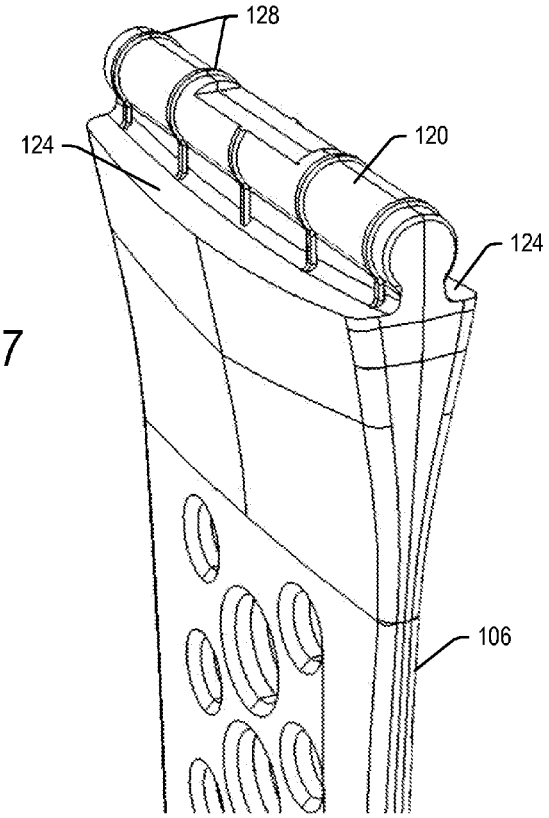
FIG. 7 is a perspective view of a strap including a mounting pin and a pair of positioning curves according to embodiments of the present technology.
Figure 8:
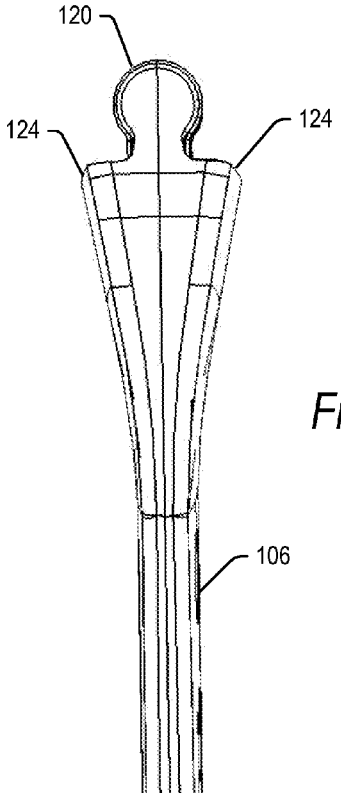
FIG. 8 is a side view of a strap including a mounting pin and a pair of positioning curves according to embodiments of the present technology.
Figure 9:
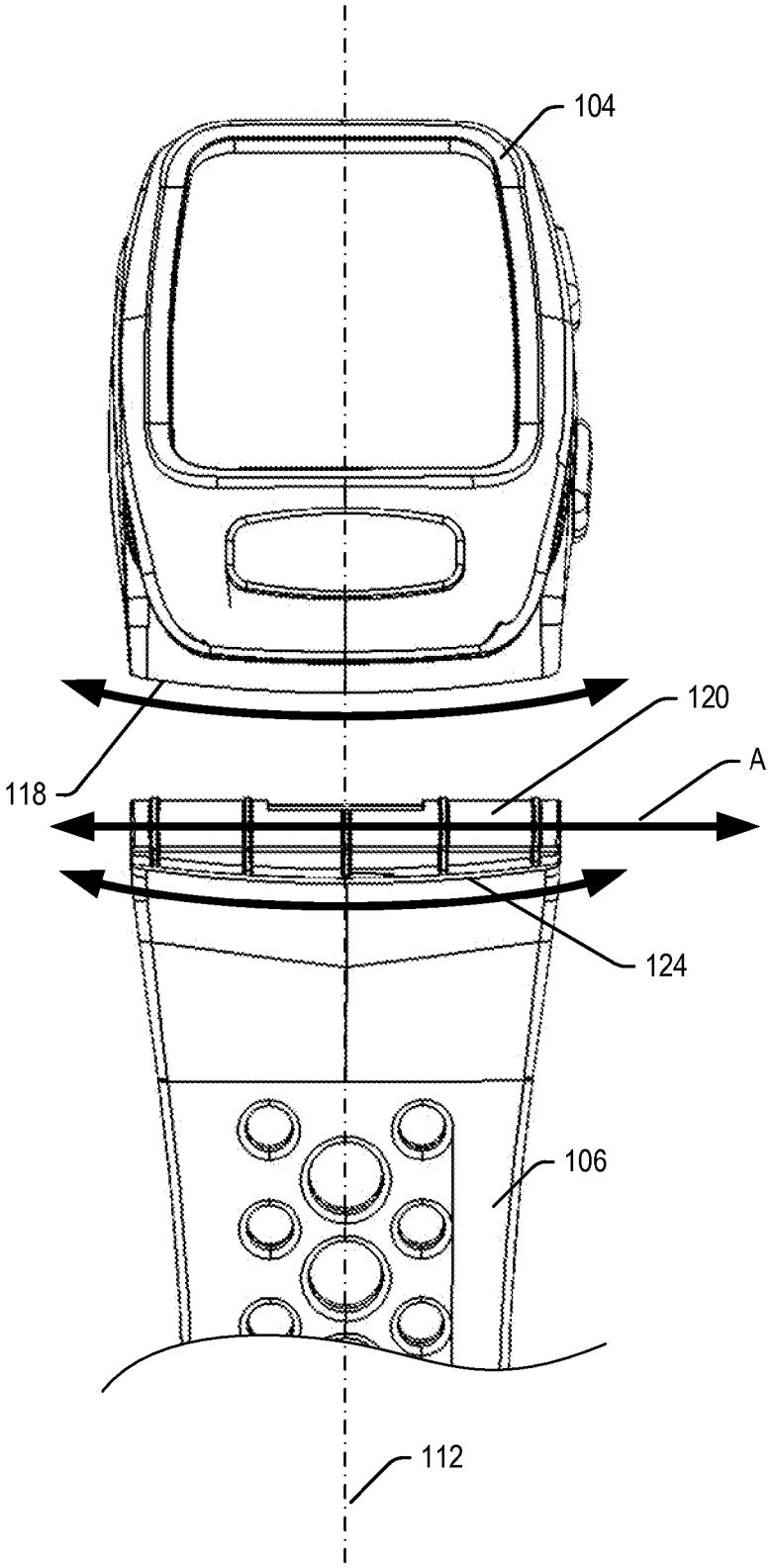
FIG. 9 is a front view of a central piece including a receiving curve and a strap including a mounting pin and positioning curve according to embodiments of the present technology.

Referring now to the perspective and side views shown in FIGS. 7 and 8, strap 106 includes mounting pin 120 configured to mate within slot 116. Mounting pin 120 extends straight across the width of strap 106 and has a shape matching the enlarged portion 116*a* of the slot 116. In embodiments, both the mounting pin 120 and the enlarged portion 116*a* of slot 116 may have a rounded shape to allow for some degree of pivoting of the mounting pin 120 within slot 116 about an axis of rotation of the mounting pin 120. However, it is understood that the mounting pin 120 and enlarged portion 116*a* may have other (corresponding) shapes in further embodiments.

The diameter of mounting pin 120 may be slightly smaller than that of the enlarged portion 116*a* of slot 116. To provide a snug fit, mounting pin may include a number of bosses 128 having a slightly larger diameter than the remaining portions of mounting pin 120. In one embodiment, the bosses 128 may be spaced approximately 6 mm from each other and have a width of 0.6 mm. Moreover, in embodiments, mounting pin 120 may have a diameter of 3.3 mm, and the bosses 128 may have a diameter of 3.6 mm (so that the bosses extend 0.15 mm above the remaining portions of mounting pin 120). It is understood at these numbers are by way of example only, and may vary in further embodiments. In this example, the enlarged portion 116*a* of slot 116 may have a diameter of approximately 3.6 mm.

Strap 106 further includes a pair of curved surfaces 124, referred to herein as "positioning curves" 124, adjacent the mounting pin 120 at the proximal end of strap 106. One such positioning curve 124 is positioned at each of the opposed surfaces of the strap 106. In embodiments, the positioning curves 124 are concave and match the shape and radius of curvature of the receiving curves 118. As noted above with respect to the receiving curves, in one example, the positioning curves 124 may have a radius of curvature of 103.35 mm. It is understood at the radius of curvature of positioning curves 124 may be larger or smaller than that in further embodiments.

If the mounting pin 120 and slot 116 had the same radius of curvature as the receiving and positioning curves 118, 124, the strap 106 could be easily affixed to the central piece 104 by rotating the mounting pin 120 and positioning curve 124 into the slot along the radius of curvature. This would allow for easy affixation, but would suffer the disadvantage described in the Background section that the strap may be easily dislodged from the central piece.

However, mounting pin 120 and slot 116 in embodiments do not have the same radius of curvature as positioning curves 124 and receiving curves 118. As noted above and as shown in the top view of FIG. 9, the mounting pin 120 and slot 116 (not shown in FIG. 9) have a straight axis. Accordingly, strap 106 is not able to rotate onto the central piece 104 along the radius of curvature. Instead, strap 106 must slide laterally transverse to the longitudinal axis 112 along arrow A.

Figure 10:
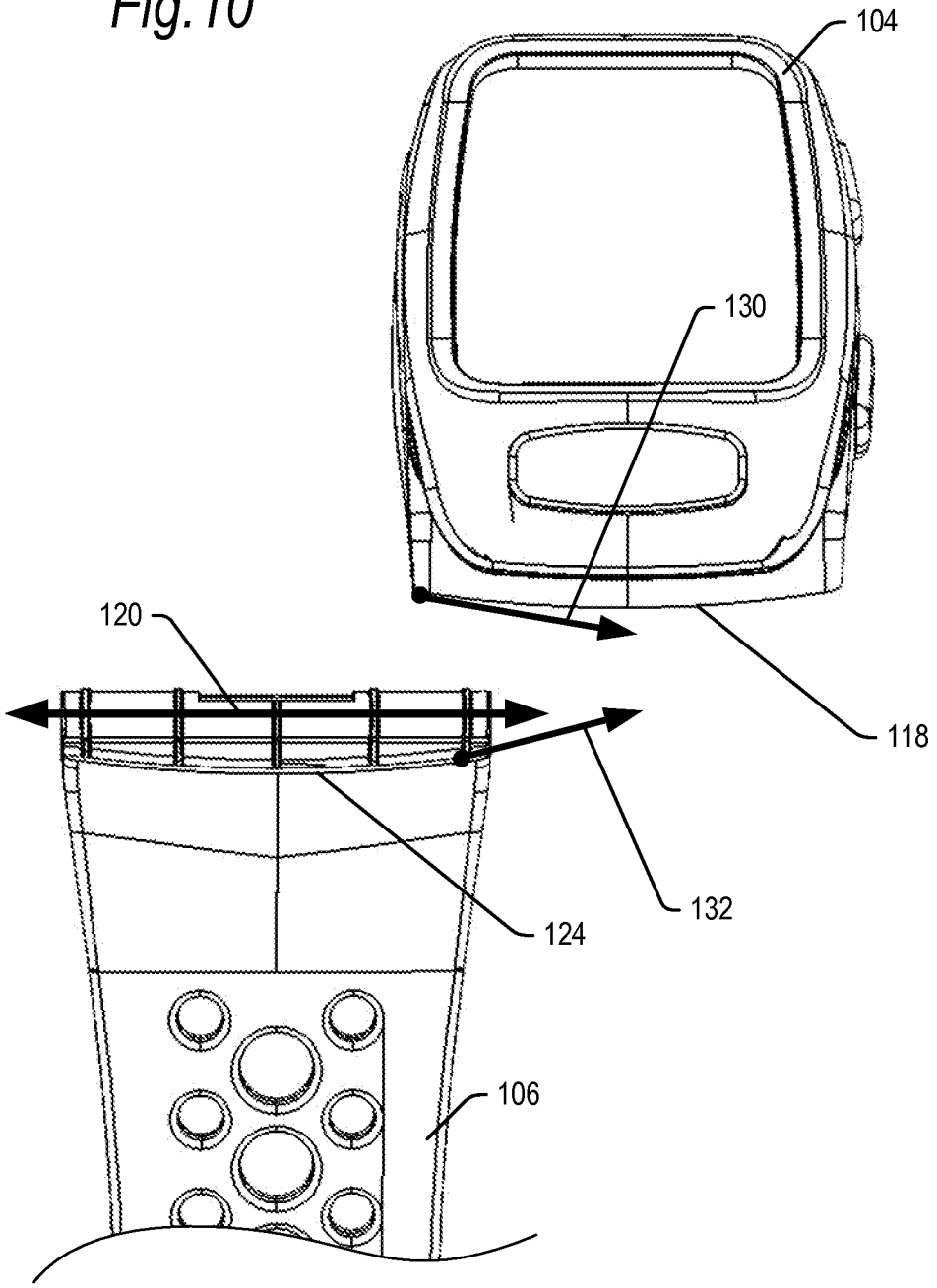
FIG. 10 is a front view of a central piece and strap, with the strap out of a centered position with respect to the central piece.
Figure 11:
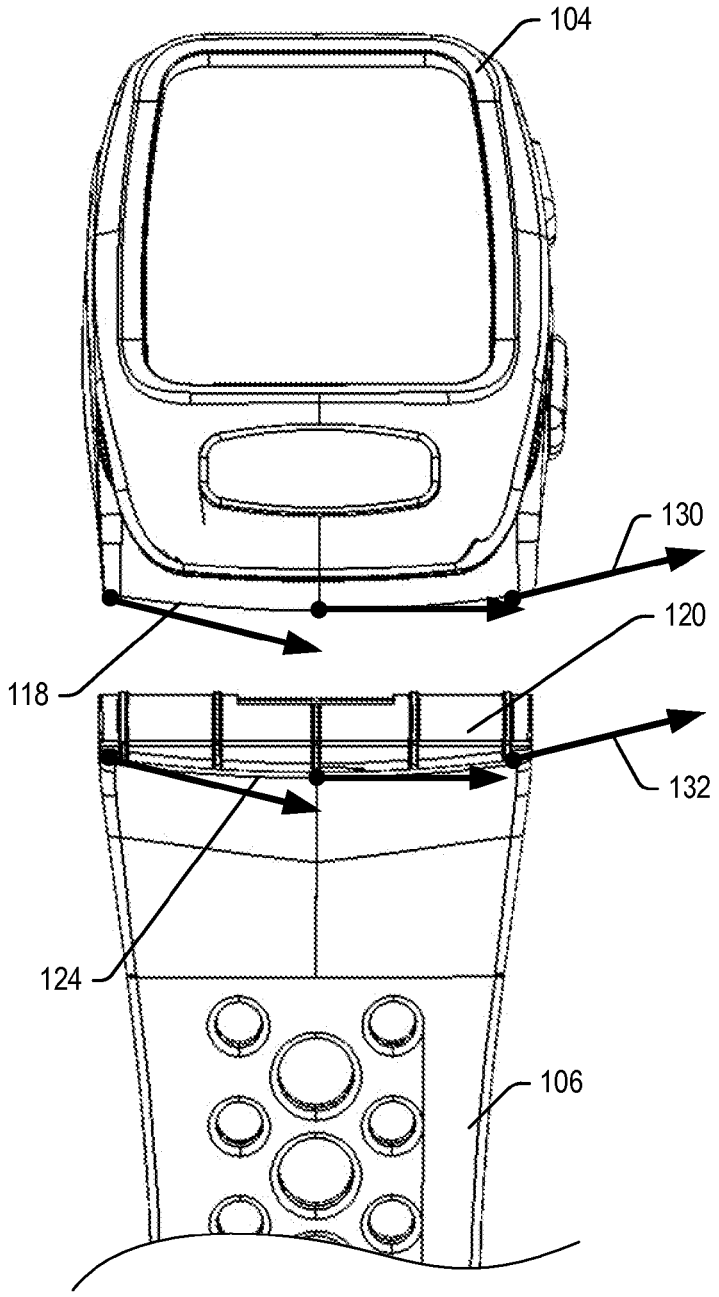
FIG. 11 is a front view of a central piece and strap, with the strap aligned and centered with respect to the central piece.
Figure 12:
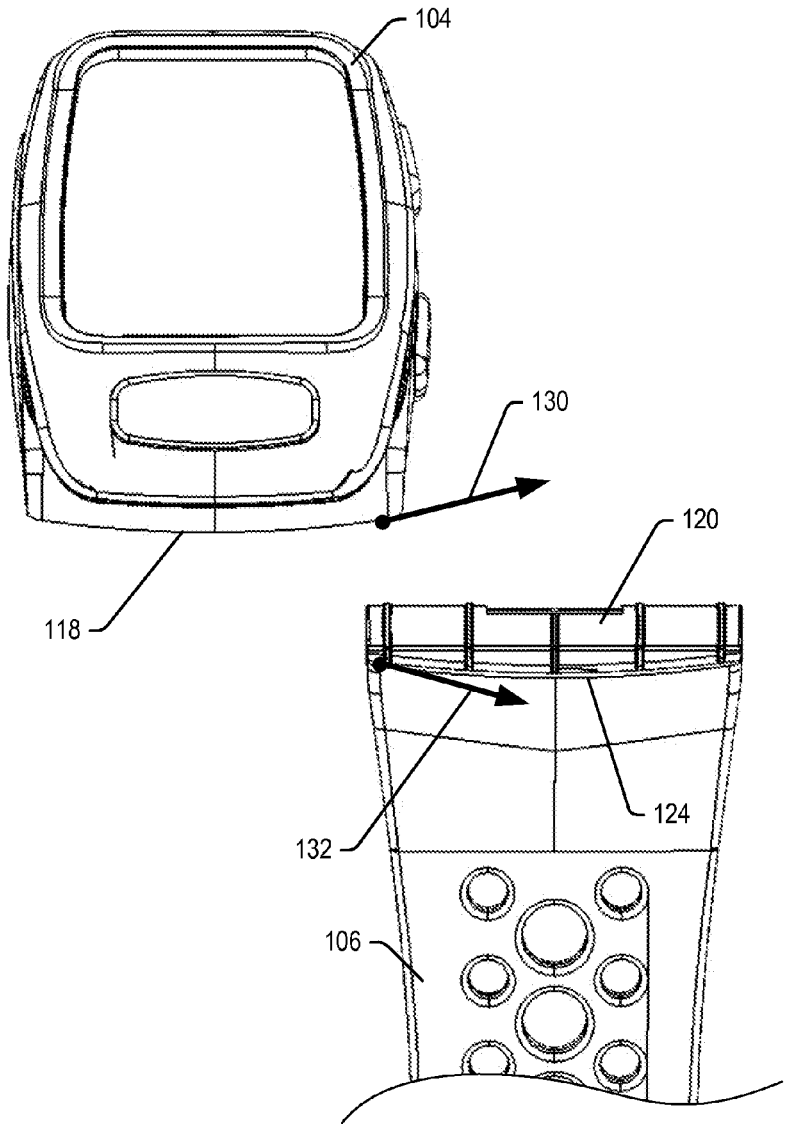
FIG. 12 is a front view of a central piece and strap, with the strap out of a centered position with respect to the central piece.

As such, referring now FIG. 10, when the mounting pin 120 of strap 106 is initially slid into the slot 116, the angle of the positioning curve 124 does not match the angle of the receiving curve 118. FIG. 10 shows a first arrow 130 tangent to a point on the receiving curve 118 initially contacted by the positioning curve 124. (The strap 106 is shown spaced away from the central piece 104 for ease of illustration, but FIGS. 10 through 12 are meant to illustrate the interaction of the curves 118, 124, mounting pin 120 and slot 116 upon sliding the strap 106 into or out of engagement with the central piece 104). A second arrow 132 is tangent to a point on positioning curve 124 that initially contacts the receiving curve 118 upon sliding mounting pin 120 into slot 116.

As can be seen from FIG. 10 and will be understood, upon initially sliding mounting pin 120 into slot 116, the portions of positioning curve 124 and receiving curve 118 that contact each other are at disparate angles and are not aligned to each other. These disparate angles at the points of contact between positioning curve 124 receiving curve 118 oppose sliding of the mounting pin 120 into slot 116. This opposition may be overcome by exerting sufficient forces laterally on the strap 106 so that positioning curve 124 elastically deforms to allow the mounting pin 120 to slide into slot 116. As noted above, strap 106 is formed of a flexible material so that it can deform in this situation.

Referring now to FIG. 11, when the mounting pin 120 is slid sufficiently into slot 116 so that the strap 106 is centered with respect to central piece 104, points of the positioning curve 124 and receiving curve 118 which lie in contact with each other are aligned with each other at the same angle. As seen by the tangential arrows 130 and 132 (only some of which are numbered in FIG. 11) the tangential arrows of respective points in contact with each other on the two curves are parallel. In this position, the positioning curve 124 is at its lowest energy state with respect to receiving curve 118. Respective curved surfaces 124 and 118 will gravitate to this lowest energy state over a higher energy state where respective curved surfaces 124 and 118 are not aligned with each other.

FIG. 12 illustrates a situation where the mounting pin 120 is being pushed laterally out of slot 116. As shown by tangential arrows 130 and 132, when pushed past a centered position, points on the positioning curve 124 and receiving curve 118 lying in contact with each other will be at disparate angles and not aligned parallel to each other. Again, this results in larger forces than when the respective curves are at the lowest energy state. These larger forces may be overcome as result of the positioning curve deforming so that the strap 106 may be separated from the central piece 104.

While the above examples of FIGS. 10 through 12 were described with respect to a strap 106 being pushed from the left to the right onto and off the central piece 104, the same interactions would apply for the strap 106 being pushed from the right to the left onto and off the central piece 104.

As the bosses 128 lie in engagement with the slot 116, forces of friction will oppose lateral movement of the mounting pin 120 once it is engaged within the slot 116. However, the aligned and mating positioning and receiving curves according to the present technology require additional forces be exerted to move the strap 106 out of a centered position with respect to the central piece 104. Moreover, when sliding a strap 106 onto the central piece 104, the mating alignment of the positioning and receiving curves when the strap is properly positioned provide a tactile catch, i.e., a satisfying tactile indicator, that the strap 106 is in its proper centered position.

Embodiments of the present technology have been described with the mounting pin 120 formed on the straps 106, 108, and the slot 116 formed in the central piece 104. However, in an alternative embodiment, the mounting pin 120 may be formed on the central piece 104, and the slot 116 may be formed in the proximal ends of the straps 106, 108. It is conceivable that the proximal end of strap 106 have a mounting pin 120, and the proximal end of strap 108 have a slot 116, or vice versa.

Similarly, embodiments of the present technology have been described with the proximal end of straps 106, 108 having a concave curve and the central piece 104 having a convex curve. However, in an alternative embodiment, the proximal ends of straps 106, 108 may have a convex curve and the central piece 104 may have a concave curve. It is conceivable that the proximal end of strap 106 has a concave positioning curve, and that the proximal end of strap 108 has a convex positioning curve, or vice versa, which mate with corresponding receiving curves on opposite sides of the central piece 104.

The foregoing detailed description of the invention has been presented for purposes of illustration and description. It is not intended to be exhaustive or to limit the invention to the precise form disclosed. Many modifications and variations are possible in light of the above teaching. The described embodiments were chosen in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

We claim:

1. A device for wearing on a body part, the device having a longitudinal axis, the device comprising:

a central piece including a display on a first surface of the central piece, the first surface opposite a second surface adapted to be worn against, and face, the body part, the central piece further comprising a slot transverse to the longitudinal axis, and a first curved surface; and a strap removably connecting to the central piece by sliding the strap in a plane parallel to the first surface of the central piece and transverse to the longitudinal axis, the strap including a mounting pin, extending across a width of the strap, removably mating within the slot of the central piece and a second surface, extending across the width of the strap and including a curve removably mating with the first curved surface.

2. A device as recited in claim 1, wherein first curved surface has the same radius of curvature as the second curved surface.

3. A device as recited in claim 1, wherein the first curved surface aligns with the second curved surface when the strap is centered with respect to the longitudinal axis on the central piece.

4. A device as recited in claim 3, wherein the first curved surface does not align with the second curved surface when the strap is not centered with respect to the longitudinal axis on the central piece.

5. A device as recited in claim 1, wherein the first curved surface is at its lowest energy state when the strap is centered with respect to the longitudinal axis on the central piece and the first and second curved surfaces are aligned with each other.

6. A device as recited in claim 1, wherein the first curved surface is convex and the second curved surface is concave.

7. A device as recited in claim 1, wherein the first curved surface is concave and the second curved surface is convex.

8. A device as recited in claim 1, wherein the strap comprises a first strap, the slot comprises a first slot and the mounting pin comprises a first mounting pin, the device further comprising:

a third curved surface on the central piece; and a second strap removably connecting to the central piece, the second strap including a second mounting pin removably mating within a second slot of the central piece and a fourth curved surface removably mating with the second curved surface.

9. A device as recited in claim 1, wherein the central piece is a monitor from the group consisting of a watch, timer, pulse monitor, pedometer, calorie counter, smart phone, video phone, digital assistant, digital display and/or calculator.

10. A device as recited in claim 1, wherein the central piece is jewelry.

11. A device for wearing on a body part, the device having a longitudinal axis the device comprising:

a central piece including a slot having a central axis along the slot transverse to the longitudinal axis and the central piece including a first curved surface having a length transverse to the longitudinal axis; and a strap removably connecting to the central piece, the strap including a mounting pin removably mating within the slot of the central piece and a second curved surface removably mating with the first curved surface, the second curved surface deformed by the first curved surface upon engaging the strap with the central piece and disengaging the strap from the central piece.

12. A device as recited in claim 11, wherein the first curved surface elastically returns to its undeformed state when the strap is centered with respect to the longitudinal axis on the central piece.

13. A device as recited in claim 11, wherein the first curved surface aligns with the second curved surface when the strap is centered with respect to the longitudinal axis on the central piece.

14. A device as recited in claim 13, wherein the first curved surface does not align with the second curved surface when the strap is not centered with respect to the longitudinal axis on the central piece.

15. A device as recited in claim 11, wherein the strap comprises a first strap, the slot comprises a first slot and the mounting pin comprises a first mounting pin, the device further comprising:

a third curved surface on the central piece; and a second strap removably connecting to the central piece, the second strap including a second mounting pin removably mating within a second slot of the central piece and a fourth curved surface removably mating with the second curved surface.

16. A method of positioning a removable strap on a central piece in a device including the removable strap and central piece, the device having a longitudinal axis the device comprising:

(a) forming a slot in the central piece transverse to the longitudinal axis;

(b) forming a first curved surface in the central piece adjacent the slot and transverse to the longitudinal axis;

(c) forming a mounting pin on the strap;

(d) forming a second curved surface in the strap adjacent the mounting pin; and (e) configuring the second curved surface to deform when the mounting pin is affixed in the slot and when the mounting pin is separated from the slot, the second curved surface deforming due to misalignment of points of contact along the first and second curved surfaces, said points of contact aligning with each other when the strap is centered within the slot.

17. The method of claim 16, further comprising the step of minimizing an energy state in the second curved surface when the first and second curved surfaces are centered with respect to each other.

18. The method of claim 16, further comprising the step of minimizing an energy state in the second curved surface when the first and second curved surfaces are aligned with respect to each other.

19. The method of claim 16, further comprising the step of configuring the first and second curves to resist lateral movement of the mounting pin in the slot when the first and second curves are aligned and centered with respect to each other.

20. The method of claim 16, further comprising the step of configuring the first and second curves to provide a tactile catch when the first and second curves are moved into alignment and centered with respect to each other.

21. A device for wearing on a wrist, the device having a longitudinal axis, the device comprising:

a central piece including a first surface adapted to be worn against, and face, the wrist, and a second surface opposite the first surface, a reference axis being defined generally perpendicular to the second surface, the central piece comprising:

a slot having a straight axis transverse to the longitudinal axis, the slot having an at least partially circular cross-section, and a first, convexly-curved surface adjacent the slot; and a strap removably connecting to the central piece, the strap comprising:

a mounting pin having a cross-section shaped to removably mate within the slot of the central piece, and a second, concavely-curved surface removably mating with the first curved surface by sliding the strap relative to the central piece transverse to the longitudinal axis and the reference axis, the first curved surface aligning with the second curved surface when the strap is centered with respect to the longitudinal axis on the central piece, and the second curved surface deforming when the strap is engaged with the central piece but not centered with respect to the longitudinal axis on the central piece, the first curved surface engaging the second curved surface when the strap is engaged with the central piece but not centered with respect to the longitudinal axis on the central piece.

22. A device as recited in claim 21, wherein the strap comprises a first strap, the slot comprises a first slot and the mounting pin comprises a first mounting pin, the device further comprising:

a third curved surface on the central piece; and a second strap removably connecting to the central piece, the second strap comprising:

a second mounting pin removably mating within a second slot of the central piece, and a fourth curved surface removably mating with the second curved surface.

23. A device as recited in claim 22, wherein the fourth curved surface aligns with the third curved surface when the second strap is centered with respect to the longitudinal axis on the central piece, and the fourth curved surface deforming when the second strap is not centered with respect to the longitudinal axis on the central piece.

24. A device for wearing on a wrist, the device having a longitudinal axis, the device comprising:

a central piece having a major planar surface, the central piece comprising:

a first slot having a straight axis transverse to the longitudinal axis, a first curved surface adjacent, but not within, the first slot, a second slot having a straight axis transverse to the longitudinal axis, a second curved surface adjacent the second slot; and a strap removably connecting to the central piece, the strap comprising:

a mounting pin having a straight axis transverse to the longitudinal axis, the mounting pin being removably matable within the first and second slots of the central piece, and a third curved surface, the third curved surface being removably matable with the first curved surface by sliding the strap relative to the central piece transverse to the longitudinal axis and generally parallel to the major planar surface, and the third curved surface being removably matable with the second curved surface by sliding the strap relative to the central piece transverse to the longitudinal axis.

25. A device as recited in claim 24, the third curved surface aligning with the first curved surface when the strap is mated in the first slot and centered with respect to the longitudinal axis on the central piece.

26. A device as recited in claim 25, the third curved surface deforming when the strap is mated in the first slot but not centered with respect to the longitudinal axis on the central piece.

27. A device as recited in claim 26, the third curved surface aligning with the second curved surface when the strap is mated in the second slot and centered with respect to the longitudinal axis on the central piece.

28. A device as recited in claim 27, the third curved surface deforming when the strap is mated in the second slot but not centered with respect to the longitudinal axis on the central piece.

29. A method of positioning a removable strap on a central piece in a device including the removable strap and central piece, the device having a longitudinal axis the device comprising:

(a) forming a slot in the central piece having a straight axis transverse to the longitudinal axis;

(b) forming a first curved surface in the central piece adjacent the slot;

(c) forming a mounting pin on the strap;

(d) forming a second curved surface in the strap adjacent but spaced from the mounting pin; and (e) configuring the second curved surface to align with the first curved surface when the strap is centered with respect to the longitudinal axis on the central piece, and configuring the second curved surface to be deformed by the first curved surface when the strap is initially slid into engagement with the central piece but not centered with respect to the longitudinal axis on the central piece.

30. The method of claim 29, further comprising the step of configuring the first and second curves to resist lateral movement of the mounting pin in the slot when the first and second curves are aligned and centered with respect to each other.

31. The method of claim 29, further comprising the step of configuring the first and second curves to provide a tactile catch when the first and second curves are moved into alignment and centered with respect to each other.

32. A device as recited in claim 29, wherein the strap comprises a first strap, the slot comprises a first slot and the mounting pin comprises a first mounting pin, the method further comprising:

(f) forming a second slot in the central piece having a straight axis transverse to the longitudinal axis;

(g) forming a third curved surface in the central piece adjacent the slot;

(h) forming a second mounting pin on the second strap;

(i) forming a fourth curved surface in the second strap adjacent the second mounting pin; and (j) configuring the fourth curved surface to align with the second curved surface when the second strap is engaged with and centered with respect to the longitudinal axis on the central piece, and configuring the fourth curved surface to deform when the second strap is engaged with the central piece but not centered with respect to the longitudinal axis on the central piece.

* * * * *